US006654965B2

(12) United States Patent
Hochmuth

(10) Patent No.: US 6,654,965 B2
(45) Date of Patent: Dec. 2, 2003

(54) GOALKEEPER'S GLOVE WITH A GUSSET

(76) Inventor: Peter Hochmuth, Weissenburger Strasse 19, D-91757 Treuchtligen (DE)

( * ) Notice: Subject to any disclaimer, the term of this patent is extended or adjusted under 35 U.S.C. 154(b) by 8 days.

(21) Appl. No.: 10/020,109

(22) Filed: Dec. 7, 2001

(65) Prior Publication Data

US 2002/0100104 A1 Aug. 1, 2002

(30) Foreign Application Priority Data

Dec. 8, 2000 (DE) ..... 200 20 398 U

(51) Int. Cl.[7] ..... A41D 19/00
(52) U.S. Cl. ..... 2/161.1
(58) Field of Search ..... 2/161.1, 163, 159, 2/169, 16, 19

(56) References Cited

U.S. PATENT DOCUMENTS

| | | | | | |
|---|---|---|---|---|---|
| 1,045,231 | A | * | 11/1912 | Whitley | 2/19 |
| 1,552,080 | A | * | 9/1925 | Rainey | 2/19 |
| 1,601,277 | A | * | 9/1926 | Werle | 2/19 |
| 2,750,594 | A | * | 6/1956 | Denkert | 2/19 |
| 3,605,117 | A | * | 9/1971 | Latina | 2/16 |
| 4,295,229 | A | * | 10/1981 | Clark et al. | 2/20 |
| 4,700,405 | A | * | 10/1987 | Sternberg | 2/161.1 |
| 5,379,460 | A | * | 1/1995 | Aoki | 2/19 |
| 5,720,047 | A | * | 2/1998 | Spitzer | 2/161.1 |
| 5,758,364 | A | * | 6/1998 | Rewoldt | 2/160 |
| 5,809,571 | A | * | 9/1998 | Spitzer | 2/161.1 |
| 6,161,221 | A | * | 12/2000 | Hochmuth | 2/161.1 |

FOREIGN PATENT DOCUMENTS

| | | | | |
|---|---|---|---|---|
| DE | 3516545 | A1 * | 11/1986 | A63B/71/14 |
| DE | 4241261 | A1 * | 6/1993 | A41D/13/08 |
| DE | 19731605 | A1 * | 2/1999 | A63B/71/14 |
| EP | 336204 | A1 * | 10/1989 | A41D/13/10 |

* cited by examiner

*Primary Examiner*—Rodney M. Lindsey
(74) *Attorney, Agent, or Firm*—Sidley Austin Brown & Wood, LLP

(57) ABSTRACT

A goalkeeper's glove including a thumb and a forefinger limiting together a gusset space, with the thumb and the forefinger forming part of an inner hand surface of the glove, a gusset located in the gusset space, an edge seam associated with each of a thumb region and a forefinger region, a flexible gusset layer provided in the gusset space on the inner hand surface and secured with the edge seams associated with the thumb and the forefinger, with the gusset layer having a tear-resistant free edge extending between the two edge seams and spaced from the gusset along the thumb by at least one-forth of the thumb length.

8 Claims, 2 Drawing Sheets

GOALKEEPER'S GLOVE WITH A GUSSET

BACKGROUND OF THE INVENTION

1. Field of the Invention

The present invention relates to a goalkeeper's glove including a thumb, a forefinger limiting, together with the thumb, a gusset space, the thumb and the forefinger forming part of an inner hand surface of the glove; a gusset located in the gusset space; and an edge seam associated with each of a thumb region and a forefinger region of the inner hand surface and narrowly defining a limited inner cross-section of the thumb and the forefinger, respectively, with both edge seams running toward the gusset.

2. Description of the Prior Art

With goalkeeper's gloves of the type described above, the thumb and the forefinger of a hand of a goalkeeper wearing the glove pass well into the thumb and forefinger sections of the glove, with the thumb and forefinger sections being sidewise closed toward the gusset due to the presence of the edge seams. Because of the narrowly limited respective inner cross-sections, the thumb and the forefinger of the hand are reliably and firmly received in the thumb and forefinger sections of the glove. The gusset, which is formed by the edge seams, tightly engages the hand gusset from which the thumb and the forefinger of the hand extend.

DE 4241261A discloses a goalkeeper's glove of the type described above in which the gusset space remains empty and open. The gusset space does not contribute to the inner hand surface of the glove. With such a glove, the thumb of the hand, which is located in the thumb section of the glove, can, under an unfavorable load, as a result of natural extension, be immediately bent out of the glove.

Accordingly, an object of the present invention is to provide a goalkeeper's glove in which the gusset space is used to prevent thumb bending and to increase the inner hand surface of the glove.

SUMMARY OF THE INVENTION

This and other objects of the present invention, which will become apparent hereinafter, are achieved, according to the present invention, by providing a flexible gusset layer in the gusset space on the inner hand surface and securing the gusset layer with the edge seams associated with the thumb and the forefinger, with the gusset layer having a tear-resistant free edge extending between the two edge seams and spaced from the gusset along the thumb by a distance equal to at least one-fourth of the thumb length, and with the gusset layer widening away from the gusset.

Because of the gusset layer, the inventive goalkeeper's glove has an increase inner hand surface which increases the ball-catching reliability as the ball-engaging glove surface is increased. In the goalkeeper's glove according to the present invention, the thumb of the hand is reliably secured against outward bending resulting from a natural extension. The thumb section of the glove become attached in the gusset space, to the forefinger section, further contribution to the ball-catching reliability. The gusset layer does not tear the hand thumb upon an unfavorable load being applied to the hand. The gusset layer is a flexible part and, thus, does not affect the usability of the glove. The gusset layer had many similarities with a swimming web. The gusset layer does not adversely affect the tight positioning of the hand thumb in or guidance of the hand thumb into the thumb section of the glove.

It is particularly preferable and advantageous when the inner side surface of the gusset layer is formed of latex and/or when the inner side surface is made uneven. Latex or an equivalent material improves adhesion of the gusset layer to a catched ball, and the unevenness, e.g., waviness improves abutment of the gusset layer with the ball.

It is particularly preferable and advantageous when the gusset layer is formed of an insert that is folded backward to form the free edge. The fold improves the extension resistance of the free edge, and, generally, the folded gusset layer in much more rigid. The fold improves the overall appearance of the gusset layer and facilitate insertion of the gusset layer into the gusset space.

It is further preferable and advantageous to form the gusset layer as a separate piece and to sew it in the glove. The stitches are formed along the edges of the forefinger and the thumb sections around the gusset formed by these edges.

It is particularly preferable and advantageous when the gusset layer extends from the gusset to the free edge, and/or when the free edge, at the thumb, is spaced from the gusset at least by one-third of the thumb length. The gusset layer increases the useful surface and, thereby improves the desired ball-catching effect.

It is particularly preferable and advantageous when the thumb and forefinger-forming, inner hand part is sewed with the gusset layer by separate seams, and the edge seams connect the additional pieces of the thumb and the forefinger and additionally secure the gusset layer. In this way, the upper side of the associated region of the folded gusset layer is secured only by the edge seams. This simplifies the glove manufacturing.

It is particularly, preferable and advantageous when an intermediate piece which is located between forefinger upper and inner regions and at a side of the forefinger adjacent to the thumb, and a thumb upper hand part form an integral cut-out piece associated with the gusset layer.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
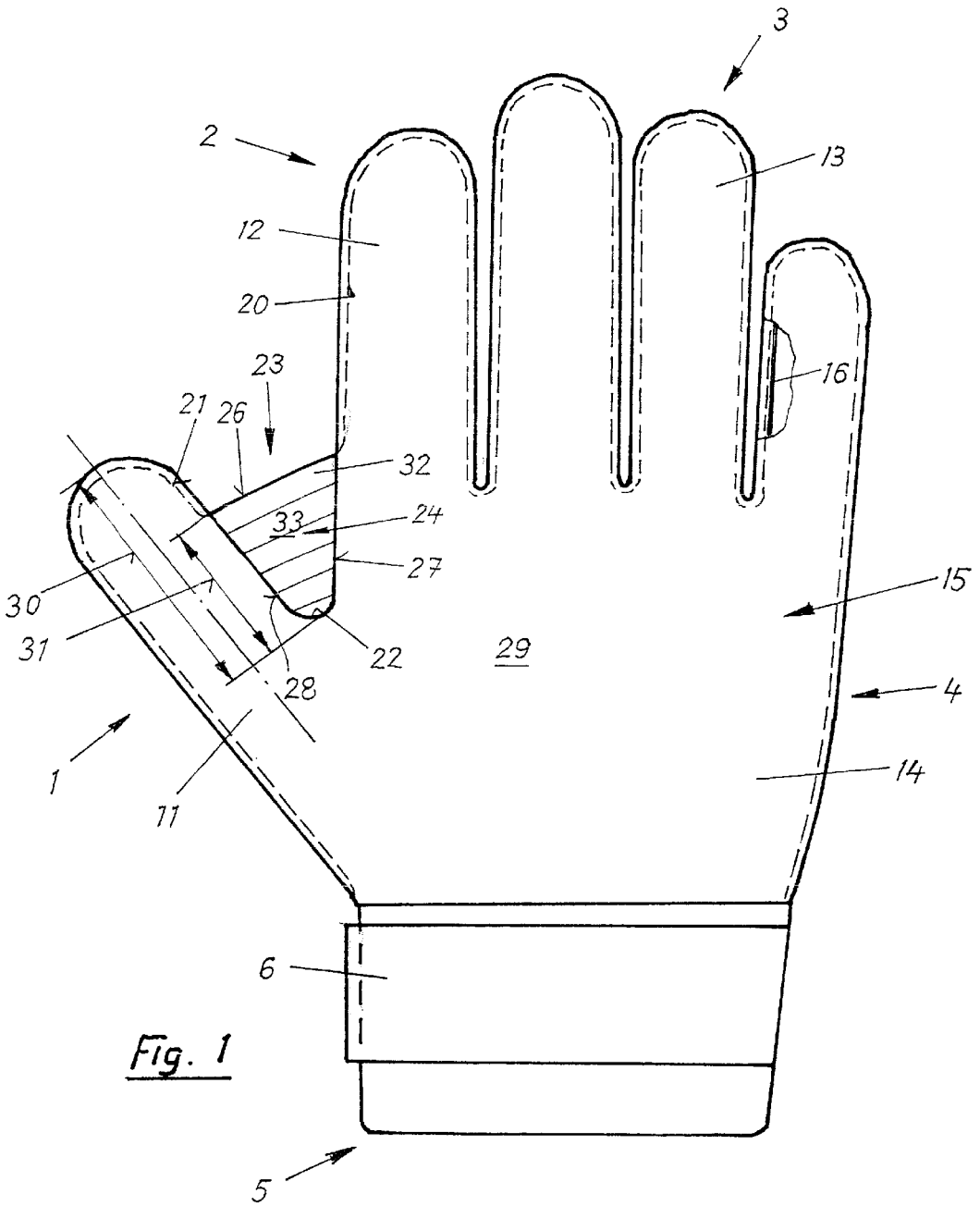
FIG. 1 shows a bottom, inner hand side, view of a goalkeeper's glove according to the present invention.

A goalkeeper's glove according to the present invention, which is shown in the drawings, had a thumb 1, a forefinger 2, three other front fingers 3, a palm/back region 4, and a wrist region 5. The wrist region 5 is surrounded by a band 6. On the upper hand side, a forefinger region 7, three other front finger regions 8, and a back region 9 are formed by a one-piece upper hand part 10. On the inner hand side, a thumb region 11, a forefinger region 12, three other front finger regions 13, and a palm region 14 are formed by a one-piece, inner hand part 15.

Between the upper hand part 10 and the inner hand part 15, at the forefinger 2 and the three other front fingers 3, there are provided six layer strips 16 and two intermediate pieces of which only one, a forefinger intermediate piece 17, shown.

Figure 4:
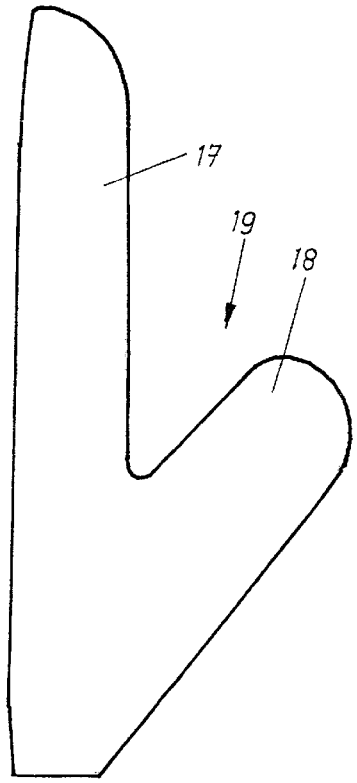
FIG. 4 shows a plan view of a cut-out section for forming thumb and forefinger regions of the goalkeeper's glove according to the present invention in its expanded condition.

For forming the thumb 1, there is provided a thumb upper hand part 18 for forming the upper hand side of the thumb 1. As shown in FIG. 4, the thumb upper hand side-forming upper hand part 18 forms with the forefinger intermediate piece 17 a one-piece cut-out section 19 that extends along the back region 9. The inner hand part 15 has its outer surface formed of latex and forms an essential portion of an inner or palm side surface 29. The intermediate piece and the layer-strips are sewed with upper hand part 10 and the inner hand part 15 by edge seams. The thumb region 11 is sewed to the thumb upper hand part 18 with edge seams. Of these seams, one edge seam 20 connects the forefinger intermediate piece 17 with the forefinger region 12, and one edge seam 21 connects the inner hand side thumb region 11 with the thumb upper hand part 18. With the bent gusset 22, both edge seams 21, 20 pass into each other and limited a gusset space 23.

Figure 3:
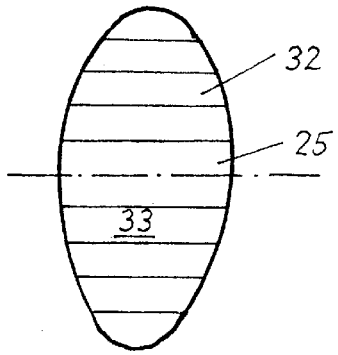
FIG. 3 shows a cross-sectional view of a gusset layer-forming insert in its expanded condition.
Figure 2:
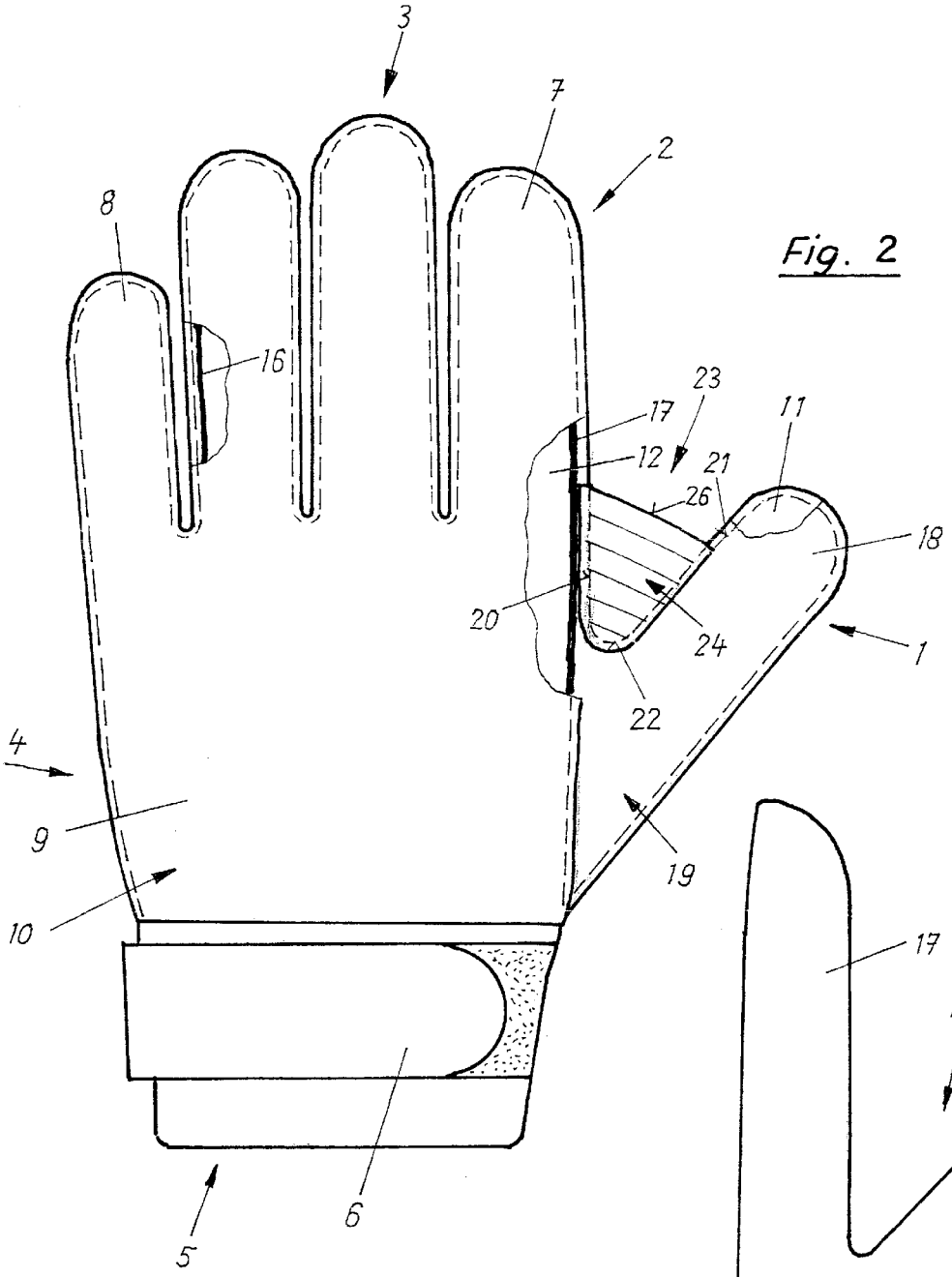
FIG. 2 shows a top, upper hand side, view of the goalkeeper's glove according to the present invention.

As shown in FIGS. 1–2, a gusset layer 24 is provided in the gusset space 23. The gusset layer 24 is formed by an insert 25, which is shown in FIG. 3. One side of the insert 25 is formed of latex having an uneven, wave-shaped surface 32, with the opposite side being formed of cloth carrier layer. The insert 25 is formed of two half-piece connected along a central line forming a free edge 26.

The inner of the half-pieces of the insert 25 is connected with the forefinger intermediate piece 17 and the thumb upper hand part 18 by seams 27, 28, respectively. The other half-piece of the insert 25, after being folded, is connected to the respective elements of the glove as shown in FIG. 2, by the edge seams 20 and 21 which, as it has been described previously, connect the forefinger intermediate space 17 with the forefinger region and the inner hand side thumb region 11 with the thumb upper hand part 18.

One of the half-pieces of the insert 25 is connected with the forefinger intermediate piece 17 and the thumb upper hand part 18 by seams 27, 28, respectively. The other half-piece of the insert 25, after being folded, is connected to the respective elements of the glove by the edge seams 20 and 21.

As shown in FIG. 1, the inner side surface of the thumb 1 has a central line along which the thumb length 30 from the gusset 22 is determined. Starting from the gusset 22, the free edge 26 has, along the central line, a length 31. The gusset layer 23 forms a surface part 33 of the inner side surface 29.

Though the present invention was shown and described with references to the preferred embodiment, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A goalkeeper's glove, comprising a thumb, a forefinger limiting, together with the thumb, a gusset space, the thumb and the forefinger forming part of an inner hand surface of the glove; a gusset located in the gusset space; first and second edge seams associated with a thumb region and a forefinger region of the inner hand surface, respectively, and narrowly defining a limited inner cross-section of the thumb and the forefinger, respectively, both edge seams running toward the gusset; a flexible gusset layer provided in the gusset space on the inner hand surface and secured to the glove with the first and second edge seams, wherein the gusset layer has a tear-resistant free edge extending between the first and second edge seams and spaced from the gusset along the thumb by at least one-fourth of the thumb length, the gusset layer widening away from the gusset, and wherein the gusset layer is formed by an insert that, upon being folded backwards, forms the free edge.

2. A goalkeeper's glove as set forth in claim 1, wherein an intermediate piece, which is located between forefinger upper and inner regions and at a side of the forefinger adjacent to the thumb, and a thumb upper hand part form an integral cut-out piece associated with the gusset layer.

3. A goalkeeper's glove as set forth in claim 1, wherein an inner side of the gusset layer associated with the inner hand surface of the glove is formed of latex.

4. A goalkeeper glove as set forth in claim 3, wherein a surface of the gusset layer, which is associated with the inner hand surface of the glove, is formed as an uneven surface.

5. A goalkeeper glove as set forth in claim 1, wherein the gusset layer-forming insert is formed as a separate piece stitched between the thumb and the forefinger.

6. A goalkeeper's glove as set forth in claim 1, wherein the free edge is spaced from the gusset along the thumb by one-third of the thumb length.

7. A goalkeeper's glove as set forth in claim 1, wherein a region of the gusset layer, which is associated with the inner hand side, is connected with a forefinger intermediate piece and a thumb upper hand part by separate seams, and wherein the forefinger intermediate piece is connected with a forefinger region by the first edge seam, and a thumb inner hand part is connected with the thumb upper hand part by the second edge seam.

8. A goalkeeper's glove as set forth in claim 7, wherein a region of the folded gusset layer, which is associated with an upper hand side, is secured only with the edge seams.

* * * * *